US005713103A

United States Patent [19]

Keebler et al.

[11] Patent Number: 5,713,103

[45] Date of Patent: Feb. 3, 1998

[54] DIRT CUP CLEANER WITH NOSE CONVERSION

[75] Inventors: A. Ronald Keebler, North Canton; Lynn A. Frederick, Brady Lake, both of Ohio

[73] Assignee: The Hoover Company, North Canton, Ohio

[21] Appl. No.: 637,522

[22] Filed: Apr. 25, 1996

[51] Int. Cl.[6] ..... A47L 5/32; A47L 9/00

[52] U.S. Cl. ..... 15/323; 15/334; 15/350

[58] Field of Search ..... 15/331, 334, 350, 15/323

[56] References Cited

U.S. PATENT DOCUMENTS

| | | | |
|---|---|---|---|
| 1,255,175 | 2/1918 | Kellogg . | |
| 2,505,631 | 4/1950 | Webster . | |
| 2,517,670 | 8/1950 | Humphrey . | |
| 2,653,343 | 9/1953 | Kunkler . | |
| 2,825,087 | 3/1958 | Meyerhoefer . | |
| 2,953,806 | 9/1960 | Walker . | |
| 3,321,794 | 5/1967 | Jepson et al. . | |
| 3,872,538 | 3/1975 | Crouser | 15/323 |
| 3,955,237 | 5/1976 | Chateauneuf et al. | 15/323 |
| 4,373,228 | 2/1983 | Dyson | 15/350 |
| 4,376,322 | 3/1983 | Lockhart et al. . | |
| 4,775,173 | 10/1988 | Sauer . | |
| 5,137,156 | 8/1992 | Riczinger et al. . | |
| 5,303,447 | 4/1994 | McKnight . | |
| 5,307,537 | 5/1994 | Essex et al. | 15/323 |
| 5,331,714 | 7/1994 | Essex et al. . | |

FOREIGN PATENT DOCUMENTS 617564 8/1935 Germany .

*Primary Examiner*—Chris K. Moore

*Attorney, Agent, or Firm*—A. Burgess Lowe; Richardson B. Farley

[57] ABSTRACT

A vacuum cleaner conversion arrangement is disclosed which, particularly, may be advantageously applied to a dirt cup cleaner. In this application, the conversion hose confluently communicates with the dirt cup when the cleaner is in converted condition so that suction air flows from the dirt cup to the motor-fan system of the vacuum cleaner in either of its floor or hose modes of operation. The conversion arrangement generally includes a conversion adapter having a closure means for sealing off its conversion hose and stanchions for conveniently mounting the ends of the same hose when it is not in use. The closure means may take the form of an outer door or an internal flapper valve plate.

25 Claims, 8 Drawing Sheets

DIRT CUP CLEANER WITH NOSE CONVERSION

BACKGROUND OF THE INVENTION

1. Field of the Invention

This invention relates to vacuum cleaners and, more specifically, to upright vacuum cleaners having hose conversion.

2. Summary of the Prior Art

The use of hose conversion in upright cleaners to adapt these cleaners to above the floor use is old and well known in the cleaner art. Such attempts have, e.g., included a variety of valved cleaners where movement of a conversion valve provides suction at the floor nozzle of the cleaner or, alternatively, at its hose end. Another arrangement for cleaner conversion utilizes removal of the suction transmitting hose end from the cleaner suction nozzle so that it may then be selectively utilized for above the floor cleaning. These methods and any known variants thereof have never to our knowledge provided for the conversion of a dirt cup cleaner. Such would obviously be, desirable, if adapted to a dirt cup cleaner, since its advantage would be provided in conjunction with the ability of its cleaner to perform above the floor cleaning. It would also be desirable to provide an improved conversion arrangement which would be advantageously utilizable in other types of upright cleaners.

Accordingly, it is an object of the invention to provide a dirt cup cleaner with above the floor conversion operation.

It is an additional object of the invention to provide an improved conversion arrangement for an upright cleaner.

It is a still further object of the invention to provide a conveniently situated hose storage means on a convertible upright cleaner.

It is a still further object of the invention to provide a simplified mounting array for the hose ends and cleaner conversion coupling piece which easily attaches to the upright cleaner.

It is also an object of the invention to accommodate above the floor conversion of a dirt cup cleaner by utilizing the suction stream through the dirt cup for communication with the conversion hose so as to then provide above the floor cleaning.

SUMMARY OF THE INVENTION

The invention comprehends the use of a conversion arrangement on a dirt cup cleaner where the normal flow of suction air is from the cleaner's nozzle up through a connection suction tube that leads to and communicates with an access port in the cleaner's dirt cup, Suction air flow is then upwardly through a cloth filter which allows the dirt to settle out in the dirt cup. A motor-fan system disposed above the filter provides the motivating force for the suction air flow.

The dirt cup is ported to provide for the conversion hose and suction tube. This conversion hose has its two ends captured (when stored) in an adapter mount attached to the dirt cup cleaner suction tube and housing. The adapter mount also includes a horizontally extending orienting shaped bore that communicates with the port in the dirt cup. The adapter bore, in the preferred embodiment of the invention, may be selectively closed by an outer door disposed thereover and hinged to the adapter mount.

In order to convert to hose operation, the hose ends are demounted from the adapter mount and its upper middle bend unhooked from an upper hook provided adjacent lower reaches of the dirt cup cleaner's handle. The adapter door is opened and the converter end of the hose is orientingly inserted into the adapter bore. A latch of the hose converter engages with the adapter mount in this position of the hose to insure retention of it in the adapter mount bore. The dirt cup cleaner is then conditioned for above the floor cleaning, with dirt being received in the dirt cup and the suction air moving from it to the motor-fan system as when this cleaner is in its floor mode.

Reconversion to the floor mode requires only that the converter hose end be unlatched and the hose removed from the adapter mount bore. The outer door is permitted to resiliently swing closed, acted upon by spring force provided by a torsion spring attached to the outer door and its underlying adapter mount. The hose ends and hose middle may then again be mounted to the dirt cup cleaner so that it is conditioned for on the floor operation.

An alternate embodiment is also shown. In it, an internal flapper valve takes the place of the outer door of the first embodiment. Otherwise, it operates and is structured generally similarly to the preferred embodiment.

BRIEF DESCRIPTION OF THE DRAWINGS

Reference now may be had to the accompanying Drawings for a better understanding of the invention both as to its organization and function, with the illustration showing a preferred and a secondary embodiment, but being only exemplary, and in which.

DETAILED DESCRIPTION OF THE INVENTION

Figure 1:
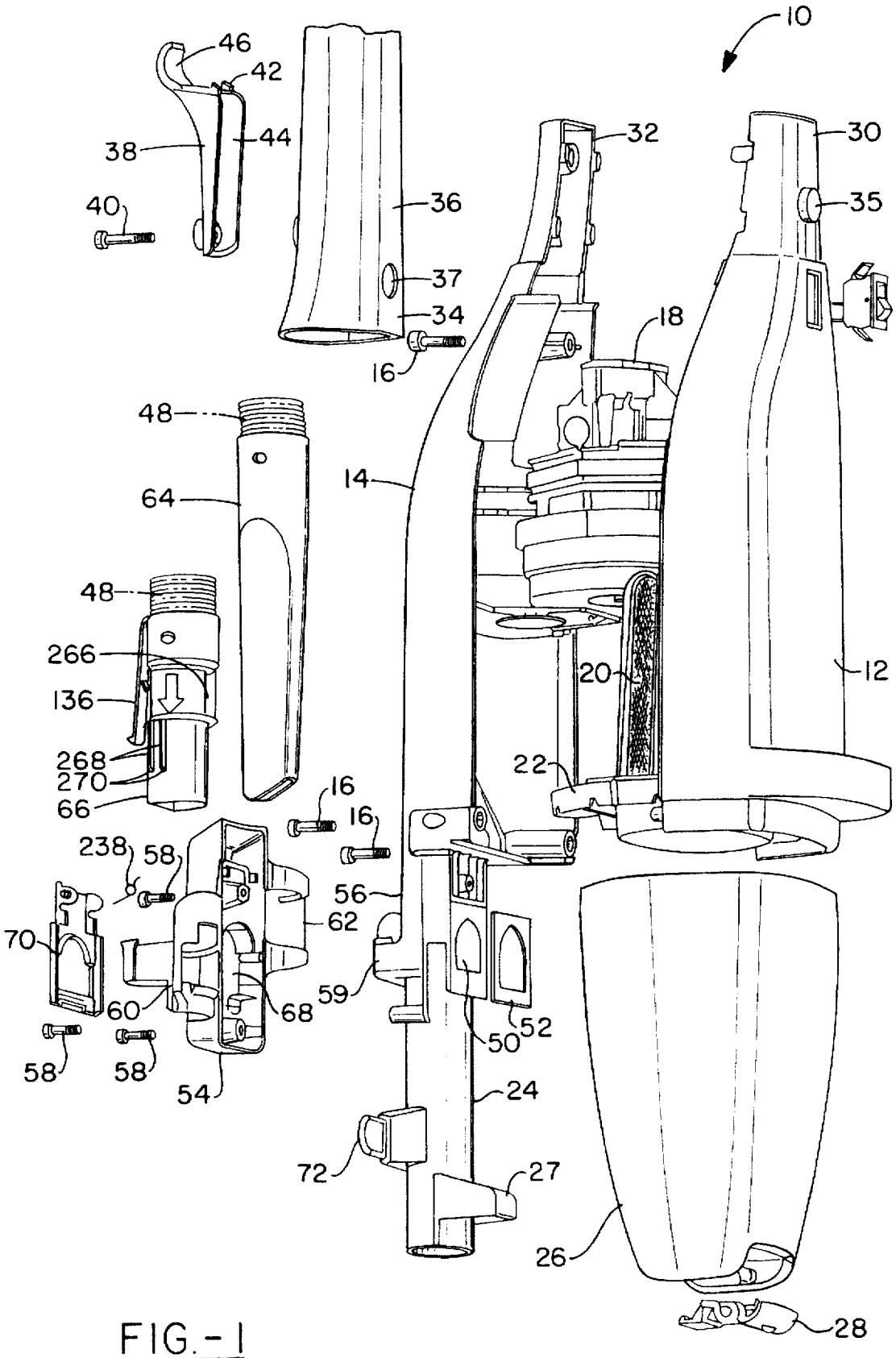
FIG. 1 is an exploded, perspective view of a dirt cup cleaner which utilizes the preferred conversion arrangement of the first embodiment of the cleaner.

There is shown in FIG. 1, a dirt cup cleaner 10 having forward and rearward housing sections 12 and 14 which are secured together in any conventional manner such as by upper and lower screws 16, 16, 16. The forward and rearward housing sections 12 and 14 provide, internally, for the mounting of a motor-fan system 18 and also receive a portion of a dirt filter 20 and its outer, resilient shaking frame 22, upwardly in their lower reaches.

Rearward housing section 14 includes an integral downward depending suction tube 24 adjacent its bottom with this tube terminating in a mounted floor nozzle (not shown). The suction tube 24 also latchingly receives therearound a dirt cup 26 through the aegis of an integral latch piece 27 on it and a mating latch piece 28 disposed on the bottom of dirt cup 26.

At the upper ends of forward and rearward housing 12, 14 their shapes converge towards their centers to form handle mounting sections 30, 32, respectively, which telescopically receive thereover a lower cleaner handle portion 34 of handle 36 (shown fragmentarily). An integral spring pressed latch button 35 integral with handle mounting section 30 in front housing section 12 engages in a circular aperture 37 in lower handle portion 34 to partly aid in their securement together.

The lower handle portion 34 mounts a large hook 38 through a lower screw 40 and an upper catch 42 which engage securely in lower handle portion 34. This hook is molded integrally with the catch 42 and may also include a generally semi-cylindrical, axially extending wall 44 to provide a large portion of its shape, strength and an extended engaging portion with lower handle portion 34. It terminates, at its upper end, in a hook portion 46, spaced sufficiently far laterally from handle portion 34 when mounted to provide for lodgement of a loop (not shown) of a hose 48 (shown fragmentarily).

A dirt cup outlet port 50, formed on upper reaches of suction tube 24, opens inwardly towards the dirt cup 26 to communicate therewith. A gasket 52 may be disposed around this exit port to provide better sealing with dirt cup 26.

An adapter mounting array 54 is mounted on the other side 56 of the upper portion of suction tube 24, generally opposite to the outlet port 50 of suction tube 24. Upper and lower screws 58, 58, 58 are utilized to attach this adapter to the suction tube 24. In mounted position, it partially telescopes over a conversion stub conduit 59, integral with suction tube 24 and confluently communicating therewith.

The adapter mounting array 54 includes a pair of shaped stanchions 60, 62 which serve as the mounting means for the hose ends 64, 66, when the hose 48 is in stored position. This adapter also includes an inwardly opening conduit section 68 which serves as a telescopic connection with conversion stub conduit 59. Both of these conduit sections confront the port 50 in suction tube 24. A spring loaded, gasketed door 70 may open or close the port 68 of the adapter 54.

A more detailed description of this dirt cup cleaner without a conversion feature may be found in Hoover Case 2449, submitted 30 Jan. 1996 and titled: "Dirt Cup Latching Arrangement".

A more detailed description of the filter and filter frame arrangement may be found in Hoover Case 2450, submitted 13 Mar. 1996 and titled: "Vacuum Cleaner Filter Shaker".

Figure 2:
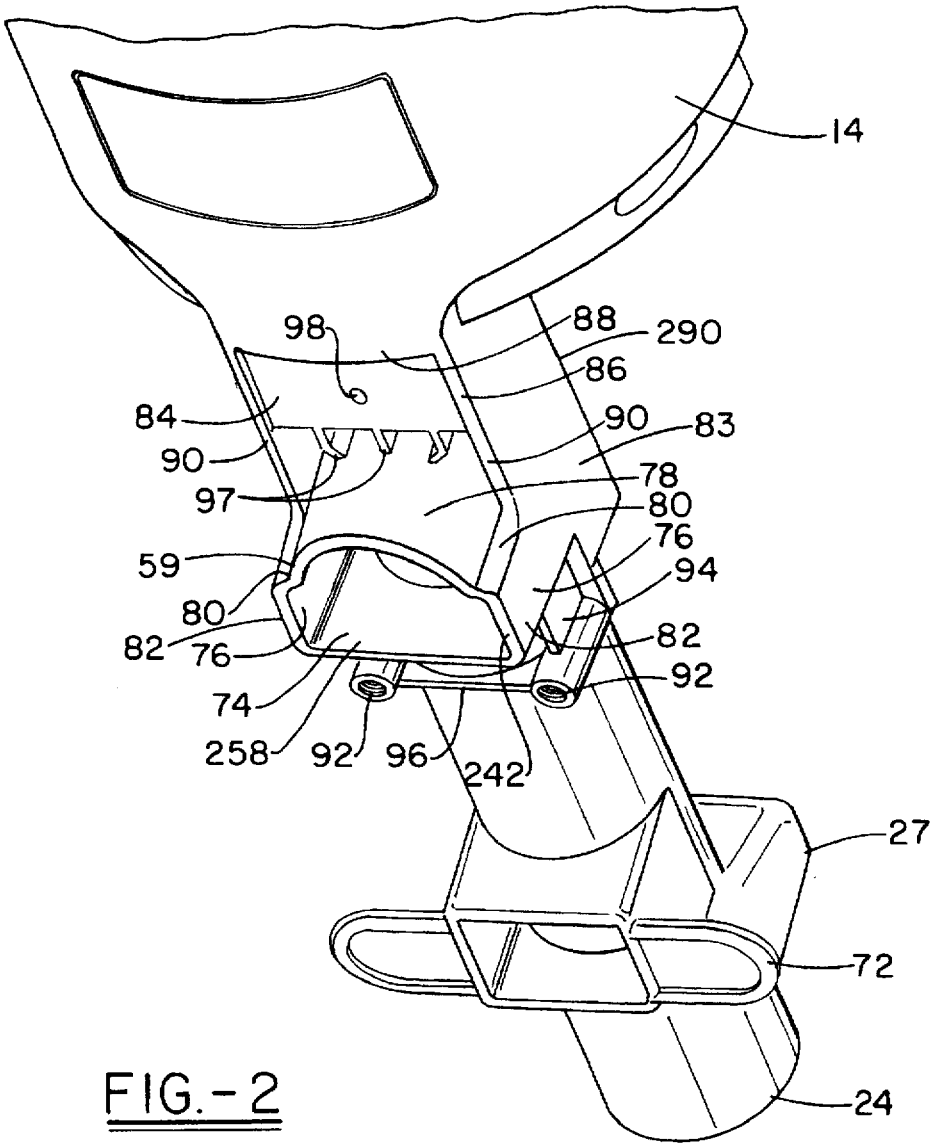
FIG. 2 is a partial perspective rear view of the rear housing section of the dirt cup cleaner of FIG. 1.

Turning now to FIG. 2, the suction tube 24 can be seen to include a cord hook 72 mounted integrally thereon and disposed below the stub conversion conduit 59 to extend transversely of suction tube 24 for the mounting thereon of a cleaner electric cord (not shown). This cord hook is arrayed above the integral suction tube latch piece 27 and on the opposite side of suction tube 24 so as to not interfere with the dirt cup's lodgment. Above the stub conversion conduit 59, its surrounding structure melds smoothly into the general outline of the rear housing section 14.

The stub conversion conduit 59 is generally D-shaped in cross section which yields both an orienting shape for the inserted hose end 66 (to be described later), and a configuration that is easily molded and generally maximizes cross section air flow area. The D-shape is formed by a bottom flat wall 74, integrally joined at its ends to a pair of vertically extending walls 76, 76 which merge at their tops with an evenly curved wall 78 extending roughly aligned with bottom flat wall 74. This occurs by the use of a pair of short step walls 80,80. These step walls facilitate the easy molding of the section of the D-shape of stub conversion shaft 59 by modulating the abruptness of its outline.

Each of the vertically extending walls 76, 76 has an outer surface 82 that is flat and extends continuously outwardly rearwardly from a flat 83 of the suction tube 24. Suction tube 24 is outwardly rectangular in outline in this area. Almost immediately above the stub conversion conduit 59 on the rear side of the suction tube 24 is another flat 84 that extends upwardly to roughly the upper termination of the outer shape of suction tube 24. This flat is slightly inset the purpose of which will soon become apparent. This inset is bordered by a rim 86 that is formed partly by an outwardly extending surface 88 of rear housing section 14, immediately above it, and a pair of vertically extending rim walls 90, 90 bordering its sides. These rim walls extend vertically downwardly and merge smoothly downwardly with the inner terminations of the outer surfaces of the short step walls 80, 80 of the D-shape of conversion stub conduit 59.

Below the conversion stub conduit 59, a pair of outwardly and rearwardly extending, transversely spaced screw bosses 92, 92 are integrally formed in the suction tube 24 to extend rearwardly, outwardly therefrom. These aid in the mounting of adapter mounting array 54 on this suction tube. These bosses are strengthened by the use of integral cross pieces therebetween such as vertical and horizontal cross pieces 94, 94 and 96, respectively. The inset flat 84 may be interrupted by ribbing 97 adjacent its bottom and joining curved wall 78 of the D-shape of stub conversion conduit 59. Such ribbing may at least reduce the volume of material necessary for the requisite cross section of the suction tube 24 at this area location. The inset flat 84 also includes a transversely aligned integrally bossed aperture 98 which also aids in the mounting of the adapter mounting array 54.

Figure 3:
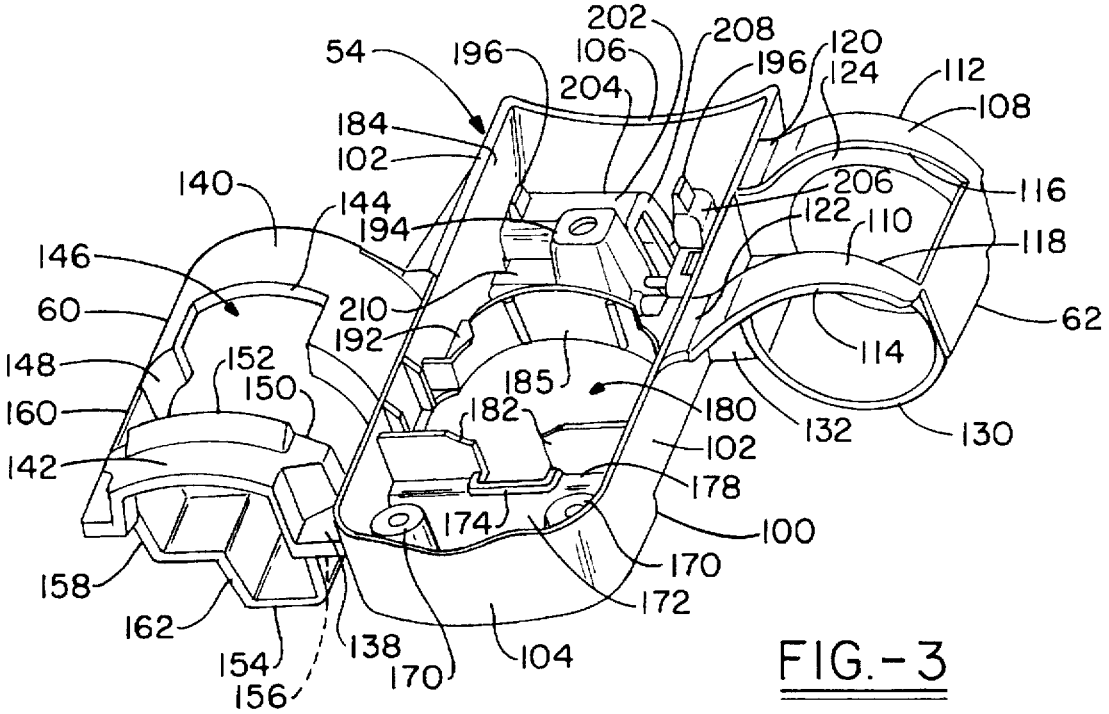
FIGS. 3 and 3A are inner perspective views of the adaptor mounting array.
Figure 3A:
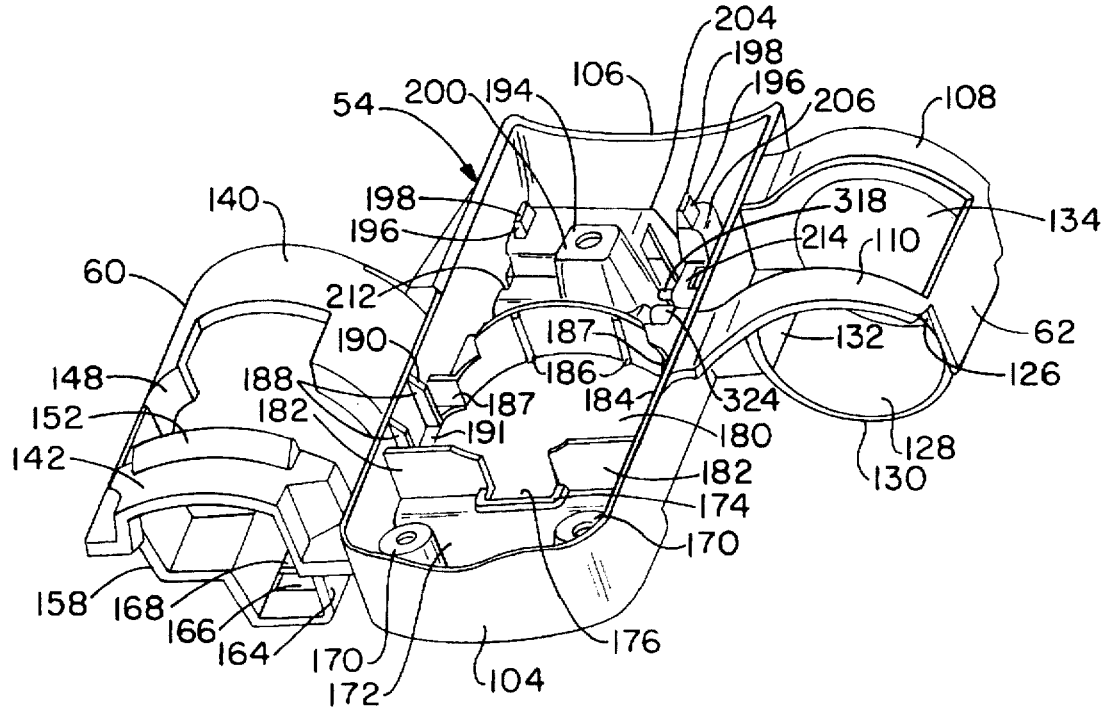
Figure 6:
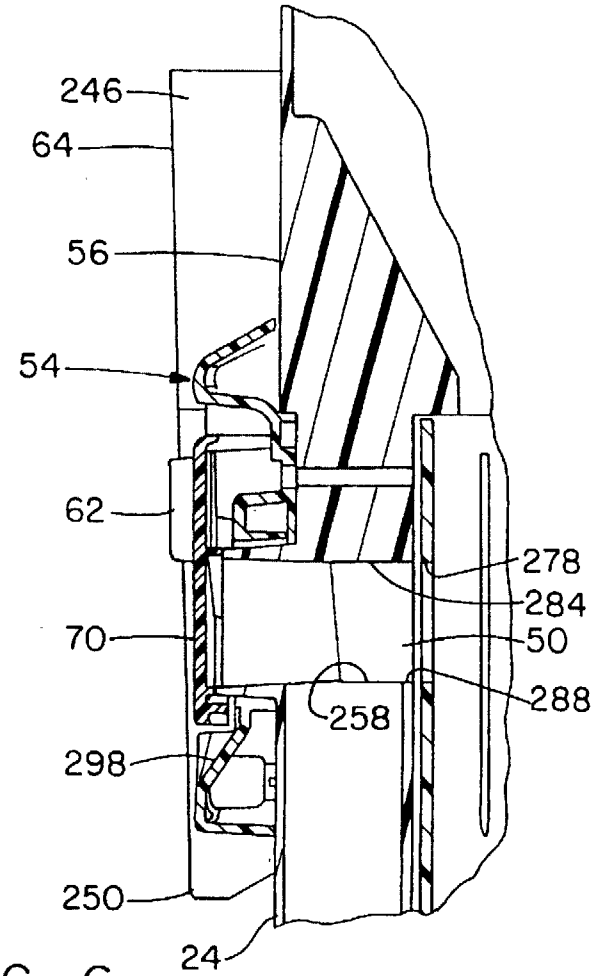
FIG. 6 is a vertical, medial cross-sectional view of the structure of FIG. 5.

Turning now to the adaptor mounting array 54 (e.g., FIGS. 3 and 3A), it can be seen that its inside side is in the form of an open box shape 100 having integral, vertically extending side walls 102, 102 joined integrally at their bottoms in a somewhat rounded fashion (largely for appearance purposes) by an integral horizontally extending bottom wall 104. The open box shape 100 is completed at its top by a horizontally extending top wall 106, integral with vertically extending side walls 102, 102. The top wall 106 is seen as angled downwardly and outwardly for streamlining of the cleaner mounted adaptor mounting array 54. Extending horizontally, transversely outwardly from vertically extending side walls 102, 102 of the open box shape 100 are the hose stanchions 60 and 62.

Hose stanchion 62 (e.g., FIG. 5) receives frictionally, conventionally, therein the hose end 64 which may ideally take the form of a crevice tool and, is in fact, the hose end held by the consumer when conversion operation is effected. Hose stanchion 60 receives therein hose end 66 by a latching arrangement (to be described). This hose end is the one removably attached confluently to the suction system of the dirt cup cleaner 10 when conversion operation is effected.

Hose stanchion 62 is formed with a pair of vertically extending upper and lower web members 108, 110, respectively, which are almost semi-cylindrical in plan view. The web members are widest at their ends near their respective vertical side wall 102 and angle downwardly and upwardly on their upper and lower edges 112, 114, respectively, while their innermost edges 116, 118 are generally horizontal, spaced and parallel. Shaping the web members in this manner conserves material, provides a pleasing appearance and yet yields a strong enough web to be functionally durable. The webs 108 and 110 are also spaced from their side wall 102 by short integral arms 120, 122, respectively, so that the inserted hose end 64 does not interfere with the near side wall 102 or the open box shape 100.

Integral with the lower and upper surfaces of the upper and lower web members 108, 110, at their inner edges 116, 118, are a pair of narrow band-like horizontal flanges 124, 126, respectively. These band-like horizontal flanges extend from the outer sides of the terminating edges 116, 118 to cover the top edges of the short arms 120, 122 and frictionally receive a portion of the outer surface of hose end 64 against their inner partially cylindrical edges. The remainder of the cylindrical surface of hose end 64 which is received in hose stanchion 62 is frictionally received against a partially cylindrical surface 128 of a partially cylindrical, oppositely facing band 130, disposed intermediate of the upper and lower web members 108, 110. The oppositely facing band 130 also includes an integral spacing arm 132 joining it to its adjacent vertical side wall 102. A peripherally extending space 134, disposed between the upper and lower web members 108, 110, permits molding of the oppositely facing band 130.

The hose stanchion 60 functions in a differing manner than the hose stanchion 62 when mounting the hose end 66 since it includes a latch 136 (FIG. 1) which attaches the hose end 66, selectively, either to its stanchion 60 or the suction system of dirt cup cleaner 10.

To this end, the hose stanchion 60 includes an integral, vertical wall attaching arm 138 which extends for the full height of the stanchion and spaces the remainder of the stanchion 60 from the box shape 100 of the adapter mounting array 54. This arm has integral upper and lower vertically spaced webs 140, 142, respectively, extending therefrom. The upper web is partially cylindrical in plan and has a step 144 in the bottom side of its vertical wall to provide a space 146 that extends medially into the upper web 140 and then downwardly between the upper and lower webs 140, 142. The upper web also includes a narrow, integral band-like hose end positioning and strengthening flange 148 (e.g., FIGS. 3 and 3A) that extends around the lower internal periphery of the upper web 140 in its area not defined by intrusion of space 146. The upper web 140 is differently shaped and generally wider than either of the opposite-side webs 108, 110 since additional strength must be provided to this web because of its stepped nature and its differing hose end latching function.

The lower web 142 also is not tapered but is generally uniform in height. In plan view, it takes the shape of a portion of the modified D-shape that it mirrors, in outline and dimensions, that is, a portion of the curved wall 78 of the stub conversion conduit 59, the purpose of which will become clear later. The lower web also includes on an upper edge 150 that includes a medially situated short outwardly angled ramp portion 152 that serves as a lead in angle for the insertion of the hose end 66.

Disposed integrally with the stanchion 60 and situated vertically between the upper and lower webs 140, 142, is a latch aperture carrying portion 154. It is generally U-shaped in plan view and mounted integrally to the vertical wall formedly attaching arm 138 by integral right angle shaped pieces 156. Another and similar right angle piece 158 attaches the other side of latch carrying portion 154 to an integral, vertically extending spacing and strengthening strut 160, disposed between the upper and lower webs 140, 142, respectively. Each of the right angled pieces 156, 158 includes as an extension at their inner ends of an outwardly extending connecting piece 162, 164, respectively, that extend inwardly, relative to the stanchion 60, from the latch aperture carrying portion 154. Each of these connecting pieces 162, 164 and a portion of the right angle pieces 156, 158 completes an outline (plan view) of the straight sides of the before described D-shape of the stub conduit 59 and the latch 136.

The U-shape formed by the latch aperture carrying portion 154 and its connecting pieces 162, 164 provides an open space for an intruding portion (to be described later) of the latch 136 to be received therein. A rectangular horizontally opening latching aperture 166 in latch carrying portion 154 provides one half of the actual locking function for the hose end 66 in stanchion 60. Directly above latch aperture 166, latch aperture carrying portion 154 includes an angled ramp piece 168 forming an easy lead in to permit engagement of the latch 136 therein.

Within the open box form 100 of the adaptor mounting array 54 are a pair of lower inwardly projecting vertically aligned circular hollow bosses 170, 170. These bosses are located so that when the adaptor mounting array 54 is assembled and drawn up tight to the dirt cup cleaner suction tube 24 (see below) they abut the suction tube bosses 92, 92. Immediately above the bosses 170, 170, an inclined ramp 172 extending upwardly and inwardly is formed integrally with the inside of the adaptor mounting array 54. This ramp provides a lead in angle on its outer opposite side for the latch 136. An inwardly, extending, upwardly opening, U-shaped, raised border 174, utilized for latching purposes, is disposed above and centered on the inclined ramp 172. This border is of relatively short height and forms three sides of the periphery of a hose end latching through aperture 176. It opens at the border's sides to an inner flat 178 formed by the front wall of the adaptor mounting array 54. The flat 178 is conveniently disposed at generally the same inner face plane at which the upper, inner end of inclined ramp 172 terminates.

Above the flat 178 and the hose end latching arrangement 176 is a stub conversion conduit through passage 180. This passage is bordered by lower short spaced horizontally extend bottom walls 182, 182 inner sides 184, 184 of the adaptor mounting array vertical walls 102, 102, an arched wall 185 and short horizontally extending top straight walls 187, 187 disposed at the lower ends of the arched wall 185. This provides the general D-shape necessary for the insertion of the stub conversion conduit 59 when the adaptor mounting array 54 is mounted to the suction tube 24 over the stub conversion conduit 59. The latching aperture 176 opens to the through passageway 180 at its upper side.

All of the walls forming the D-shape include internal small ribs such as the ribs 186, 186, 188 and 188 that extend generally for the full depth of the D-shaped through passage 180. The bottom walls also include a pair of ribs (not shown) similar to the ribs 186, 186. These ribs may be molded with more precision than their respective walls to provide better centering of the total assembly. Ideally the ribs 188, 188, disposed on the sides of the "D" may include angled lead in ends 190, 190 for easy mounting over the suction tube stub conduit 59. Below and outwardly rearwardly of line ribs 188, 188, they may each merge into a thin border 191 of the same depth as the flat 178 so that it forms, on its other side, a portion of the outer surface of the adaptor mounting array 54.

Above the conversion through passage 180, another flat 192 is disposed. This flat, like the flat 178, is formed by the other side of a wall that forms a portion of the outer face of the adaptor mounting array 54. Above the flat 192, another hollow integral boss 194 of generally square cross section extends into the area bounded by the box shape 100. This boss is centered from side to side relative to the box shape 100 and is limited in its inward projection so that a pair of spaced tabs 196, 196, having inner surmounting faces 198, 198, project beyond an inner face 200 of boss 194. Tightening of the upper screw 58 into this boss and screw aperture 98 in the suction tube flat 84 above stub conversion conduit 59 then causes the tabs 196, 196 and bosses 170, 170 of the adapter mounting array 54 to be pulled tight against the remainder of the dirt cup cleaner 10 by imposing a tension force on the adapter mounting array 54.

One of the tabs 196, 196 (the leftward one in FIGS. 3 and 3A) extends integrally inwardly from an inner face 202 of an inwardly jutting, box like housing protrusion 204 in an upper portion of the space formed by the open box shape 100. This box like protrusion is open outwardly and provides clearance for the door 70 to swing to open position (to be described later). The rightward tab 196 extends inwardly from a projection 206 that is, essentially, a continuation of the box like housing 204, with this box like housing and the projection 206 separated by a slot 208. This slot houses the resilient arrangement which constantly urges the closure of door 70 (both to be described later).

Below the box like protrusion 204 and the projection 206, is the journalling means for the pintled door 70. This journalling means comprises a short housing piece. 210, disposed to the left of upper boss 194 of adapter mounting array 54 and including a pintle receiving aperture 212 on its outer wall that confronts the leftward vertical wall 102 of the adaptor mounting array 54 and an inward apertured wall of a pintle receiving yoke 214 disposed spacedly away oppositely from the boss 194 and on the same side of the slot 208 as the rightward tab projection 206.

Figure 4:
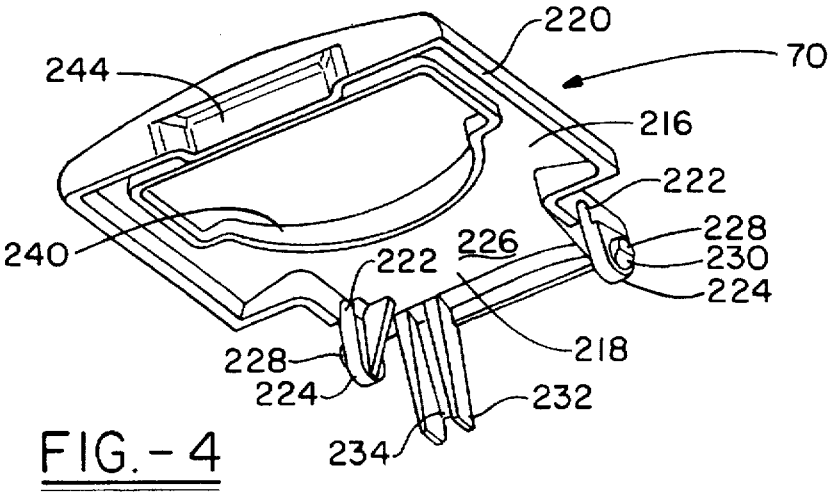
FIG. 4 is a bottom perspective view of the conversion door.

Turning now to the door 70 (e.g., FIG. 4), it can be seen that it has a generally T-shaped outline to provide a wider bottom closure section 216 and an integral upper hinge attaching section 218. A peripheral border 220 generally extends completely around these two sections except at a discontinuity 222, on each side of the upper hinge attaching section 218 and between the top side of the border 220 and the upper termination of the sidewalls of upper hinge attaching section 218. An internally ribbed hinge lug 224 extends outwardly from an inner surface 226 of the door 70 in each of the discontinuities 222. Each of the ribbed hinge lugs 224, 224 includes on its outer side a sidewardly extending integral pivot pintle 228 that may be provided with a cam angled end 230 for ease in assembly of the door 70 to the adaptor mounting array 54.

Figure 10:
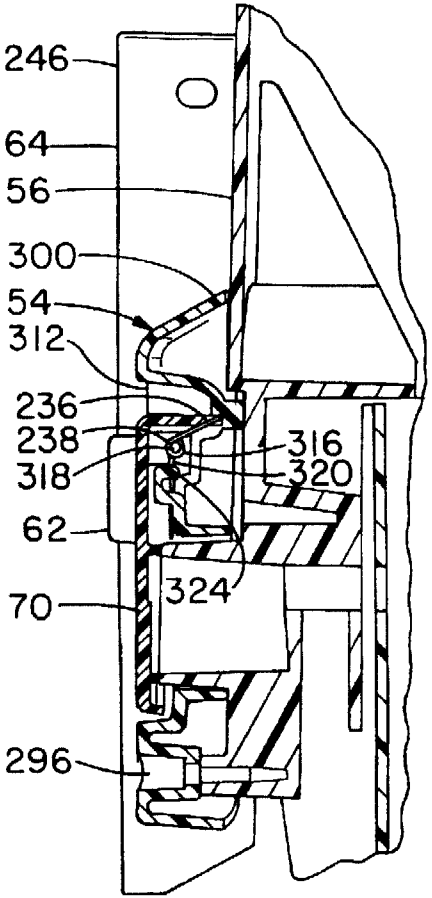
FIG. 10 is a cross-sectional medial elevational view of the structure shown in FIG. 9 and taken through the most leftward lower fastening means.
Figure 9:
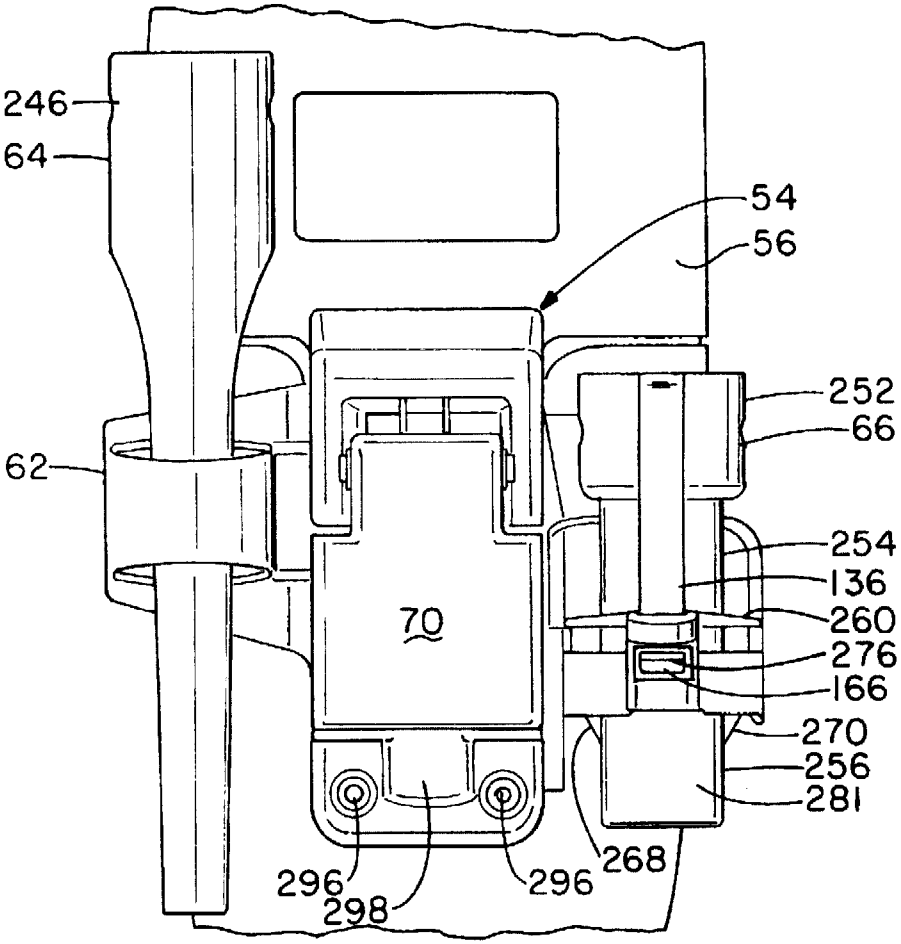
FIG. 9 is an elevational view of the structure of FIG. 5 and with the door closed.

Inwardly of the leftward internally ribbed hinge lug 224 (FIG. 4), a torsion spring end receiving strut 232 integrally juts downwardly from the inner surface 226 of the door 70 and into the volume of the mounting array 54 (e.g., FIG. 10). This strut extends beyond the innermost portions of the hinge lugs 224, 224 so that a center, vertically extending inset 234 of the strut 232 is situated to receive an end 236 of a door closing torsion spring 238. The inset 234 is situated on the inner side of the strut 232 and is inset both on its inner side and vertically to effectively provide a notch for end 236 of the torsion spring 238.

The closure section 216 of the door 70 includes a shallow seal 240 integrally attached to the inner surface 226 of the door 70 and taking the shape in plan view of a stepped "D". This seal is intended to seal against an end face 242 of the stub conversion conduit 59 when the adaptor mounting array 54, closed door 70 and the suction tube 24 of the dirt cup cleaner 10 are assembled together.

The peripheral border 220 has an inset portion 244 located near the outward termination of the closure section 216. This portion is centrally located from side to side of the closure section 216 and is centered on and slightly wider than the latch aperture 176 of the adaptor mounting array 54. This provides a location for the insertion of an operator's finger so that the door 70 may be easily opened.

Figure 5:
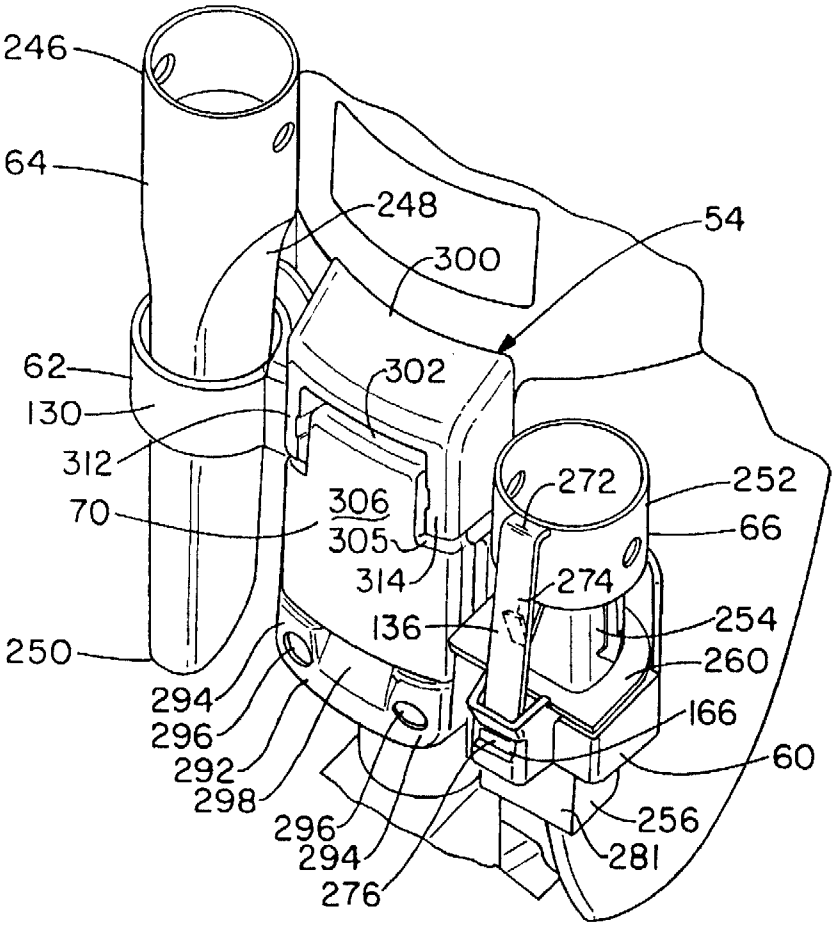
FIG. 5 is a perspective view of the adapter mounting array with mounted hose ends and in unconverted position.
Figure 8:
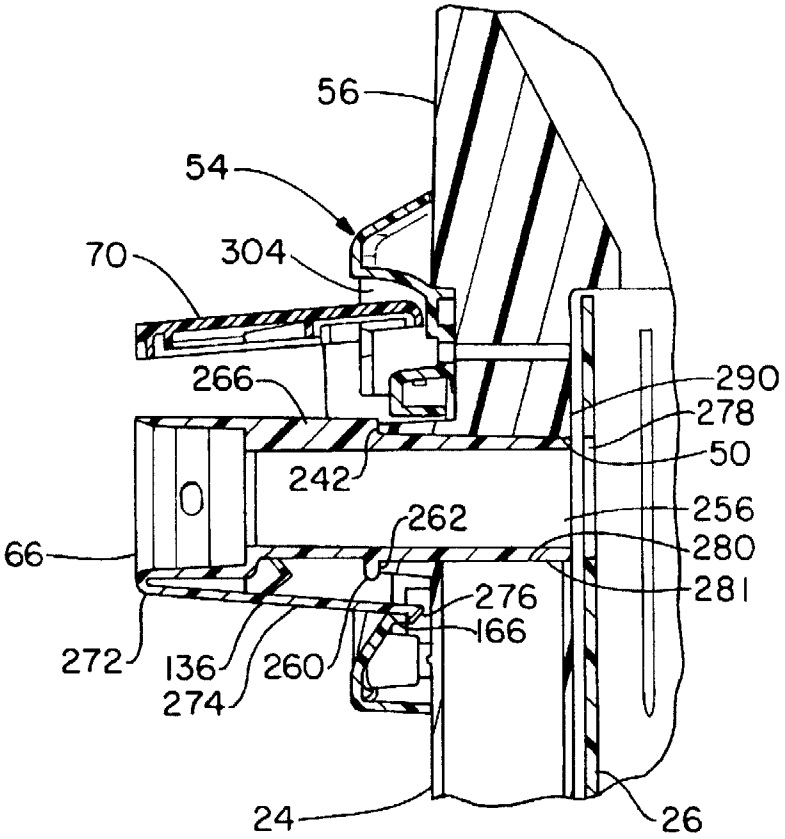
FIG. 8 is generally a vertically medial cross-sectional view of the structure of FIG. 7.
Figure 7:
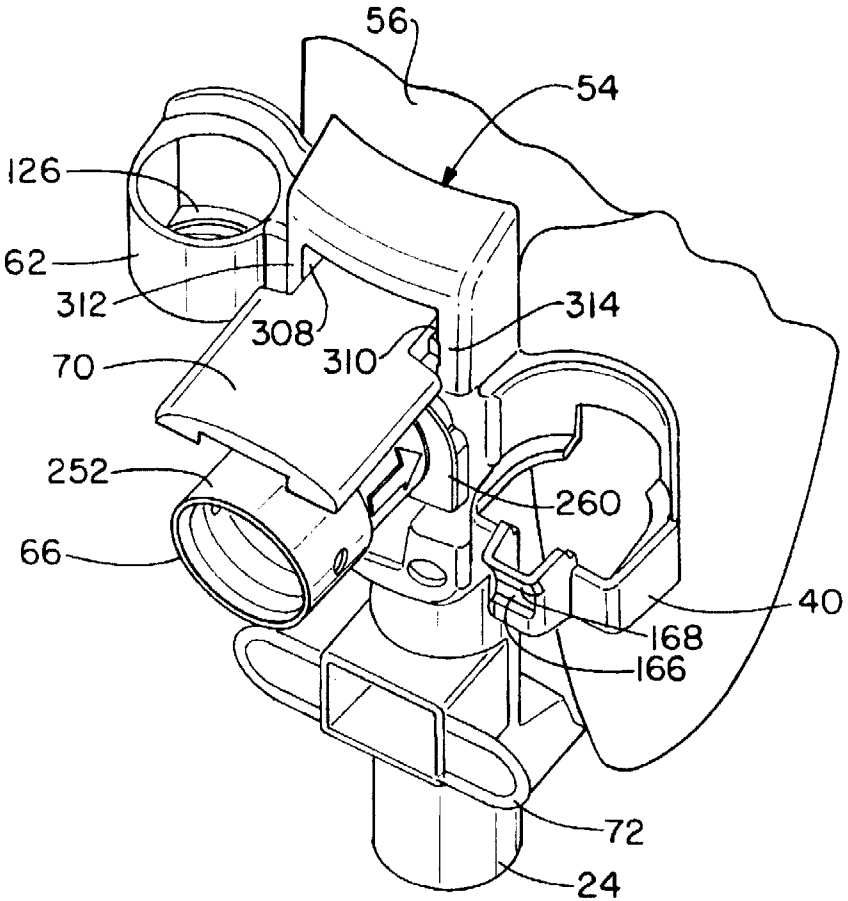
FIG. 7 is a view similar to FIG. 5 but showing the conversion position of the structure.

The front side of the adaptor mounting array 54 with the hose ends 64, 66 in stored position is shown in FIG. 5.

The hose end 64 is conventionally in the form of a crevice tool and includes an inner hollow cylindrical hose mounting portion 246 integrally joined to a necked down portion 248 which terminates in an elongated rectangularly cross sectioned, outer portion 250. The rectangularly cross sectioned, outer portion 250, as should be obvious, is frictionally received between the webs 108, 110 and the band 130.

The hose end 66 serves as a coupling member for the hose 48 when this hose is in converted position. It includes an inner somewhat enlarged hollow cylindrical hose mounting portion 252, an integral "D" section shaped intermediate portion 254 and an outer "D" section shaped telescoping conversion portion 256. For even air flow, the cross sectional opening area of the "D" section shaped intermediate portion 254 is selected to be substantially the same (but reduced by wall thickness) as the cross sectional opening area of the stub conversion conduit 59 while the cross sectional opening area of the conversion potion 256 is the same.

The cross sectional opening of the outer "D" shaped section 256 is slightly smaller than the intermediate portion 254 so that this section will telescope within an internal bore 258 of the stub conversion conduit 59. The outer "D" shaped section 256 includes a "D" shaped flange 260 at its junction with the intermediate "D" shaped section 254. During conversion, an inner face 262 on this flange abuts against the end face 242 on the terminating outer end of the stub conversion conduit 59. The stub conversion conduit 59 extends slightly beyond through passageway 180 of adapter mounting array 54 in assembled position for this purpose. This abutment serves as the seal between the hose 48 and the suction tube 24.

A strengthening rib 266 extends axially between the outer end face of hose mounting portion 252 and the opposite face of the "D" shaped flange 260 of hose end 66. A pair of upper and lower ribs 268, 268, 268, 268 (only two shown) also extend axially from the face 262 of the "D" shaped flange 260, towards, but short of the outer end of the "D" shaped outer section 256. These ribs are each provided with an angled lead in end 270 so that the "D" shaped section 256 of hose end 66 may be easily inserted into the stub conversion conduit 59 until the faces 242, 262 engaging abut.

The inner hollow cylindrical hose mounting portion 252 of hose end 66 includes the integral axially outwardly extending latch 136. This latch includes an attaching portion 272, an axially extending integral spring finger 274 and catch portion 276. In stored position of the hose end 66, the catch portion 276 of the latch 136 is engaged in latch aperture 166 of the hose stanchion 60. In conversion position of the hose end 66, the catch portion 276 of the latch 136 is engaged in the latch aperture 176 of the adaptor mounting array 54.

When the hose end 66 is totally inserted into the stub conversion conduit 59 it extends fully through the through passageway 180 of the adaptor mounting array 54 and the stub conversion conduit 59 to directly confluently communicate with a D shaped dirt cup through entrance port 278 in dirt cup 26. This entrance port receives suction air passing up the suction tube towards the motor-fan system 18 from the nozzle (not shown), in the unconverted position of the dirt cup cleaner 10, or suction air passing through the hose fitting 66 towards the motor-fan system 18 in the converted position of the dirt cup cleaner 10.

These two alternate positions are accommodated easily with the insertion and removal of the hose fitting 66. With the hose 48 removed and the door 70 closed, air moves directly from the suction tube 24 through the dirt cup port 278 and into the confines of the dirt cup 26. The floor nozzle (not shown) is then operative to clean whatever floor covering it contacts.

With the door 70 open and the hose fitting 66 inserted into the stub conversion conduit 59, a port 280 formed at the upper end of the suction tube 24 is sealingly closed off by a flat side 281 of the D shape of the fitting 66 so there is a direct flow through from this fitting to dirt cup entrance port 278. This seal is assured because the stepped D shape of a through bore 282 of stub conversion conduit 59 (formed by the walls 74, 76, 76, 78, 80, 80) has a pure inner bore shape D section 284 at its inner end of slightly smaller dimension. It is formed by the use of a pair of spaced inner, vertical walls 286, 286 which extend from a rear inner corner of each of the step walls 80 vertically downwardly to the bottom surface of the through bore 282 and an upper curved wall 287 connected thereto. These walls are spaced inwardly from the inner ramped ends of the inserted, paired ribs 268, 268, and 268, 268 sufficiently far so that the hose fitting 66 will properly seat in the stub conversion conduit 59. This places their terminating walls in a position approximately midway across the port 280 of stub conversion valve 59. The D shape 284 then is congruent with and only minimally larger than outer D shaped portion 256 of hose fitting 66. The D shaped portion 284 also extends through a similarly shaped through opening 288 terminating the through bore 282 in a flat wall 290 formed in an upper portion of suction tube 24. The flat wall 290, below the opening 280, terminates above a horizontal line drawn through the centers of bosses 92, 92 and its inner face is disposed inwardly at the same inward intrusion of the innermost outer surface of suction tube 24.

Turning to the outer side of the adaptor mounting array 54, it can be seen to include an integral lower raised portion 292 whose front has an upwardly open U-shaped appearance. Each of the legs 294, 294 of the U-shape include a countersunk aperture 296 which is centered on and opens inwardly to its respective boss 170, disposed on the inner side of the adaptor mounting array 54. Between the two legs 294, 294, an angled flat 298 angles upwardly and inwardly towards the door 70 to generally complete the lower raised portion 292. Since this flat extends inwardly beyond the inner surface of door 70, and the door 70 is inset on its inside at this location by its inner inset 244, a convenient recess is provided for an operator's finger for manipulation of the door 70 to open position.

Below the top wall 106 of the adaptor mounting array 54 is disposed another integral raised portion 300 having a downwardly facing U-shape. The door 70 is mounted within the U-shape of the raised portion 300, but spaced downwardly from a bottom side 302 of the bight portion of the U-shape to provide a clearance 304 for the door 70 as it swings upwardly to open position. During this door movement clearance is also provided by the space encompassed by the inwardly disposed but outwardly opening box housing 204 of the adaptor mounting array 54. The door 70 is also mounted inset in an inset 305, formed inwardly between the raised portions 292, 300 so that when closed, its outer face 306 is flush with the outer surfaces of the raised portions 292, 300.

Inner walls 308, 310 of the depending legs 312, 314 of the downwardly facing U-shape of integral raised portion 300 include the pintle apertures 212, 215, these walls being outward continuations of the outer walls of the inner housing 210 and pintle receiving yoke 214 of adapter mounting array 54. As aforesaid, the inner housing 210 and pintle receiving yoke 214 are situated on the inner side of this adaptor mounting array. Since the door pivot pintles 228 have cam angled ends, the door 70 is, obviously, easily hingedly mounted to the adaptor mounting array 54 in the inset 305 provided in its outwardly facing side.

The door 70 is spring urged closed by the torsion spring 238. It includes a center coiled portion 316 mounted over an integral sidewardly extending pin 318 which extends from the inner side of upper boss 194. The spring's one end 236 can be seen lodged in the notch formed by the inset 234 of the spring strut 232 of the door 70. Its other end 320 reacts against a rounded rib 324, parallel to the pin 318, and integral with a portion of the inner side of the adaptor mounting array 54, also adjacent to the upper boss 194.

This last paragraph completes the description of the preferred embodiment.

Figure 12:
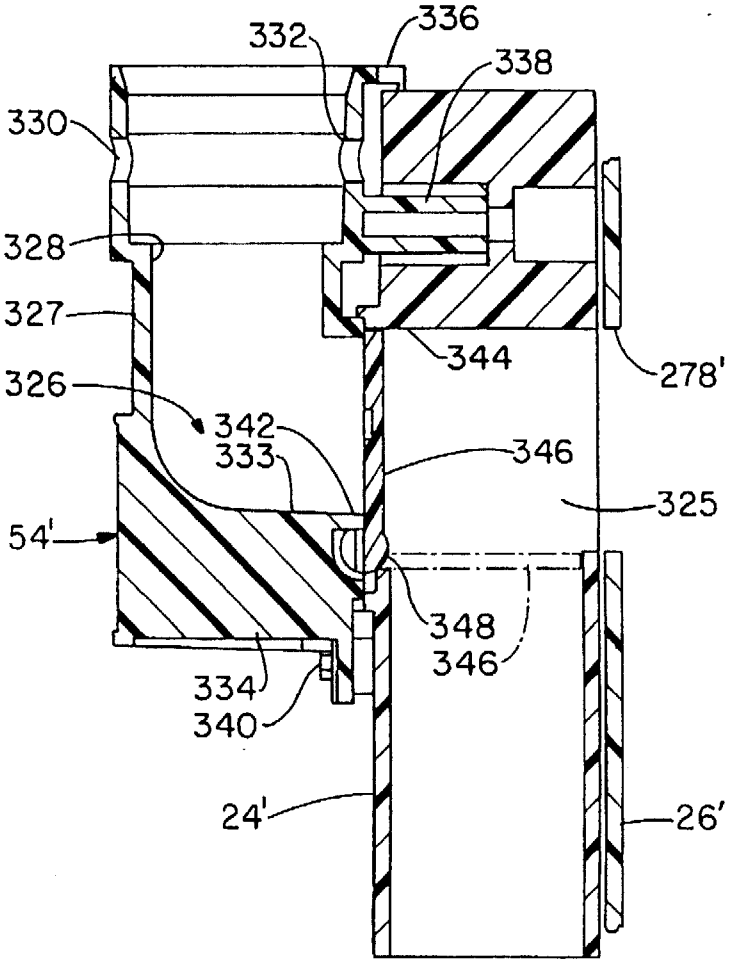
FIG. 12 is a fragmentary vertical cross-sectional view of the second embodiment of the invention taken through the center line of the adapter conversion valve.
Figure 11:
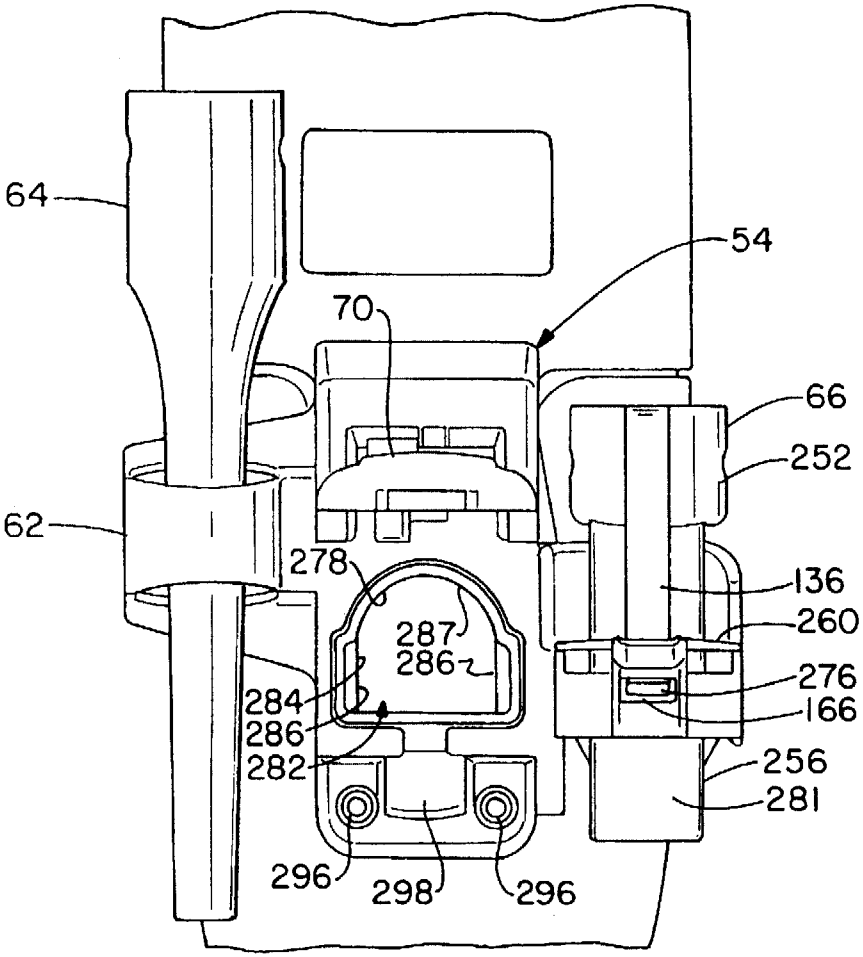
FIG. 11 is a view of the structure shown in FIG. 7 and with the door open.
Figure 13:
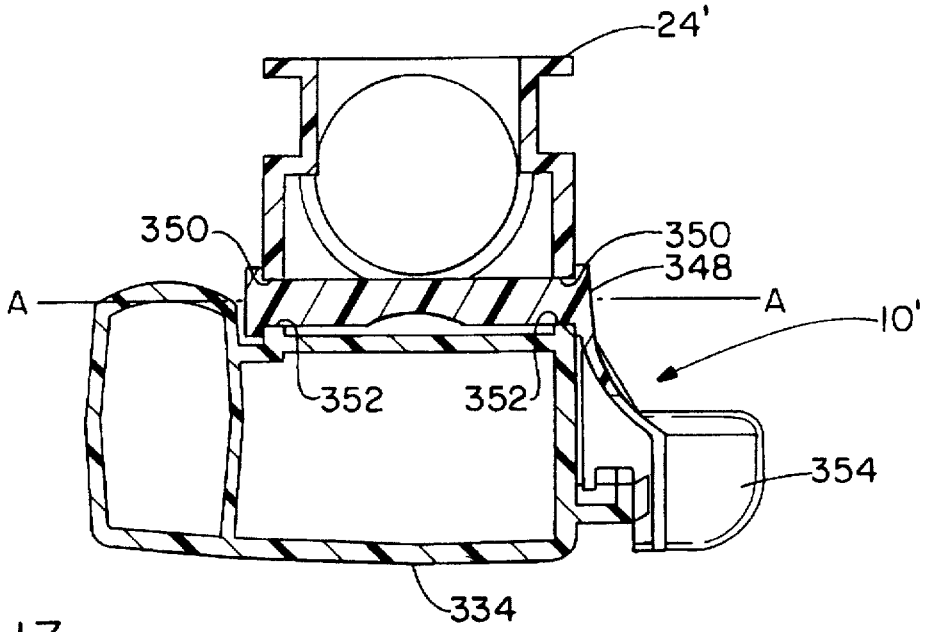
FIG. 13 is a fragmentary horizontal cross-sectional view of the second embodiment and taken through the center of the valve axle.
Figure 14:
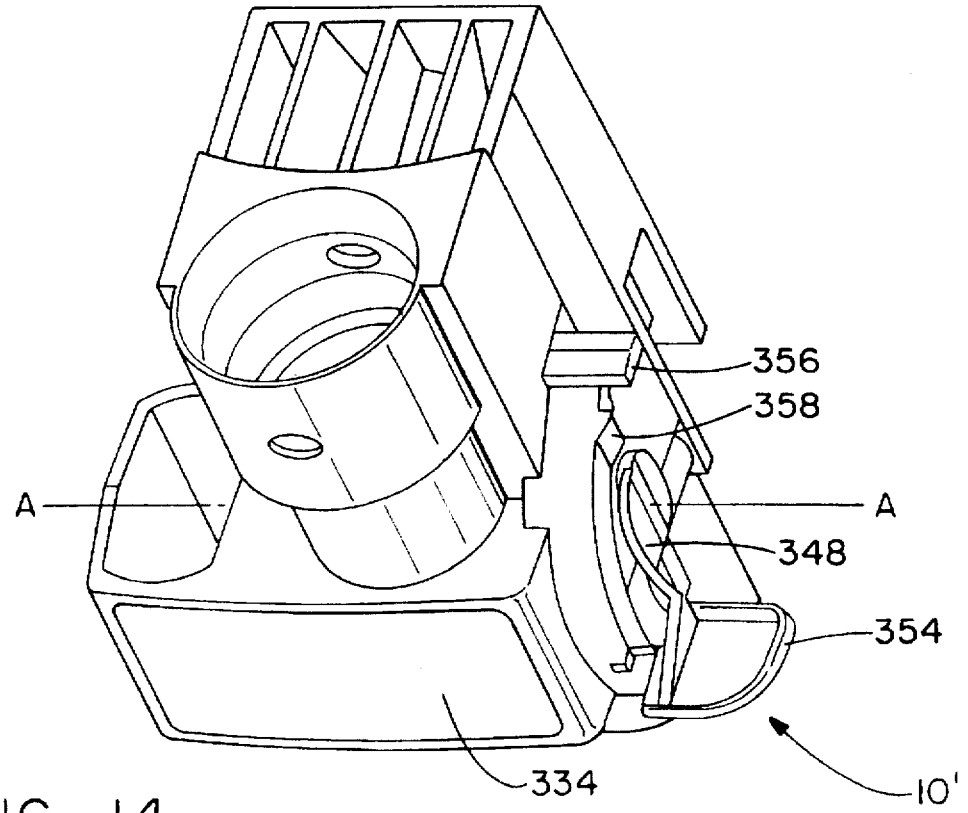
FIG. 14 is a fragmentary right perspective view of the second embodiment with particular emphasis on the adaptor mounting array.

In the second embodiment of the invention shown in FIGS. 12–14, primed numerals are utilized to indicate similar but differing elements as compared to the elements in the first embodiment and unprimed numerals are utilized for dissimilar elements. The major difference between the preferred embodiment shown in FIGS. 1–11 and this embodiment is the fact that this embodiment utilizes an internal flapper valve for conversion purposes.

This embodiment includes a dirt cup cleaner 10' having a suction tube 24' extending upwardly therein to a dirt cup 26' which has a communicating port 278' aligned with an exit port 325 in top portion of the suction tube 24'.

Attached to the upper end of suction tube 24' is a mounting adaptor array 54' which may include, if desired, hose tool stanchions (not shown), as in the first embodiment. Mounting adaptor array 54' includes a right angled bore 326 therein, an upper portion 327 formed by tubular piece 328. The tubular piece 328 merges into a hose coupling part 330 which has a corrugated bore section 332 for ease in mounting a hose end (not shown) therein. A portion of the lower horizontally extending end 333 of the right angled bore 326 is formed in a housing part 334 of the mounting adaptor array 54'. The mounting adaptor array 54' is secured to the suction tube 24' by, for example, a horizontally centered upper catch 336, an intermediate horizontally centered screw boss 338 and lower mounting bolts 340, 340 (only one shown).

At the termination of the horizontally extending lower end 333 of right angled bore 326 is a port 342 that also communicates with the suction tube 24 by means of a suction tube port 344. The ports 342, 344 are aligned with the dirt cup port 278' and confluent with the suction tube port 325.

A conversion valve member 346, formed by a flapper valve plate is disposed at the juncture of the mounting adaptor array port 342 and the suction tube port 344. This valve plate is pivoted to the adaptor mounting array 54' and suction tube 24' by means of an integral through axle 348 which is trapped between half moon surfaces 350, 350 formed on the suction tube 24' and half moon surfaces 352, 352 formed on the adaptor mounting array 54'.

On one of its sides, the through axle 348 carries an integral, cantilevered operating handle 354 which may turn the valve member 346 from its full line position in FIG. 12 to its dotted line position in this same Figure as it is moved between spaced stops 356, 356 (only one shown) integrally attached to and extending out of a side surface of the housing part 334 of the mounting adaptor array 54'. In each of these positions the operating handle 354 deformingly detents over a cam angled detent 358.

Movement of the valve member 346 from its position covering the suction tube port 344 to its position covering the suction tube port 325 places the dirt cup cleaner 10' in converted, hose mode. The reverse of this movement of the valve plate 346 again places the dirt cup cleaner 10' in its normal mode of operation. The valve member 346 is situated off center visa vis its axle 348 to insure proper seating in its two positions.

It should now be clear that all the objects of the invention have been fulfilled by the foregoing description. It should also be apparent that many changes could be made to the described invention which would still fall within its spirit and purview.

What is claimed is:

1. A vacuum cleaner including:

a) a dirt cup;

b) a nozzle suction tube leading to said dirt cup;

c) a communicating port in said dirt cup to confluently connect said dirt cup to said nozzle suction tube;

d) a conversion port in said nozzle suction tube to confluently connect to a hose conversion arrangement; and e) a motor-fan system for said cleaner for providing a suction flow of air through said dirt cup.

2. The vacuum cleaner according to claim I wherein:

a) suction air passing through said conversion port also then passes through said dirt cup towards said motor-fan system.

3. The vacuum cleaner according to claim I wherein:

a) a closure means is provided for selectively closing said conversion port.

4. The vacuum cleaner according to claim 3 wherein:

a) said closure takes the form of an outer door swingably mounted to said cleaner.

5. The vacuum cleaner according to claim 3 wherein:

a) said closure takes the form of a flapper valve plate swingably mounted to said cleaner.

6. The vacuum cleaner according to claim 5 wherein:

a) said flapper valve plate includes a manipulating handle.

7. The vacuum cleaner according to claim 6 wherein:

a) said flapper valve plate moves from an open to a closed position and from a closed to an open position; and b) detents are provided at the open and closed position of said flapper valve plate to help maintain said flapper valve plate in either of the said positions.

8. The vacuum cleaner of claim 1 wherein:

a) said hose conversion arrangement includes an adaptor having 1) a hose;

2) a mount having said hose conversion port;

b) said mount also including at least one stanchion utilized for hose storage purposes.

9. The vacuum cleaner of claim I wherein:

a) said hose conversion arrangement includes a mount having said hose conversion port; and b) said hose conversion port being aligned and coincident with said communicating port in said dirt cup.

10. The vacuum cleaner of claim 9 wherein:

a) said nozzle suction tube includes, adjacent the dirt cup, a horizontal bore portion disposed generally between the hose conversion port and the communicating port in said dirt cup.

11. The vacuum cleaner of claim 10 wherein:

a) said bored horizontal portion communicates, at its termination with said conversion port and said communicating port.

12. The vacuum cleaner of claim 11 wherein:

a) a part of said bored horizontal portion is formed by a stub conduit; and b) an adapter array is mounted telescopically over said stub conduit.

13. The vacuum cleaner of claim 12 wherein:

a) said adaptor array includes a movable closure which may selectively open and close said hose conversion port.

14. The vacuum cleaner of claim 13 wherein:

a) said movable closure takes the form of a hinged door.

15. A hose conversion adaptor for mounting on a vacuum cleaner including:

a) a bracket having a hose access hole therein; and b) said bracket also having at least one integral hose storing stanchion disposed transversely spaced from said hose access hole.

16. The hose conversion adaptor of claim 15 wherein:

a) a closure is selectively movably mounted thereon to open and close said hose access hole.

17. The hose conversion adaptor of claim 16 wherein:

a) said closure takes the form of a horizontally hinged door.

18. The hose conversion adaptor of claim 17 wherein:

a) a torsion spring urges said door to said closed condition.

19. The hose conversion adaptor of claim 18 wherein:

a) said door includes an inner seal extending around but inset from its periphery.

20. The hose conversion adaptor of claim 19 wherein:

a) said bracket mounts to said vacuum cleaner telescopically over a stub conduit of said vacuum cleaner.

21. The hose conversion adaptor of claim 20 wherein:

a) said door inner seal engages an end face of said stub conduit when said door is in said closed condition.

22. The vacuum cleaner of claim I wherein:

a) a vacuum cleaner hose end is insertable in said conversion port;

b) said vacuum cleaner hose end has an orienting shape;

c) said conversion port also has at least a partly congruent orienting shape; and d) said vacuum cleaner hose end includes a latch part;

e) whereby proper insertion of said vacuum cleaner hose end in said conversion port properly locates said latch part for latching action.

23. The vacuum cleaner of claim 22 wherein:

a) said orienting shapes are D shaped in cross section.

24. The vacuum cleaner of claim 1 wherein:

a) a vacuum cleaner hose end is insertable in said conversion port;

b) said vacuum cleaner hose end extends across said nozzle suction tube to provide a seal for it.

25. The vacuum cleaner of claim 1 wherein:

a) said hose conversion arrangement includes an adaptor having a hose conversion port; and b) a hose is mounted with said vacuum cleaner.

* * * * *

UNITED STATES PATENT AND TRADEMARK OFFICE

CERTIFICATE OF CORRECTION

PATENT NO. :5,713,103
DATED :February 03, 1998
INVENTOR(S) :A. Ron Keebler, Lynn A. Fredrick It is certified that error appears in the above-identified patent and that said Letters Patent is hereby corrected as shown below:

On the title page: Item [54] and column 1, line 1, should read -- DIRT CUP CLEANER WITH HOSE CONVERSION --.

Signed and Sealed this

Twenty-eighth Day of April, 1998

Bruce Lehman

*Attest:*

BRUCE LEHMAN

*Commissioner of Patents and Trademarks*

*Attesting Officer*